US008157587B2

(12) United States Patent
Paynter et al.

(10) Patent No.: US 8,157,587 B2
(45) Date of Patent: Apr. 17, 2012

(54) CONNECTOR STABILIZING COUPLING BODY ASSEMBLY

(75) Inventors: Jeffrey Paynter, Momence, IN (US); David Low, Frankfort, IL (US); Larry Buenz, Frankfort, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/795,013

(22) Filed: Jun. 7, 2010

(65) Prior Publication Data

US 2011/0300742 A1 Dec. 8, 2011

(51) Int. Cl.
*H01R 9/05* (2006.01)

(52) U.S. Cl. ..... 439/578; 439/454; 439/472; 439/584

(58) Field of Classification Search ..... 439/452, 439/454, 455, 470, 472, 583, 584
See application file for complete search history.

(56) References Cited

U.S. PATENT DOCUMENTS

| | | | | |
|---|---|---|---|---|
| 4,995,832 | A | 2/1991 | Thommen et al. | |
| 5,267,877 | A | 12/1993 | Scannelli | |
| 5,322,454 | A | 6/1994 | Thommen | |
| 5,796,323 | A * | 8/1998 | Uchikoba et al. | 333/260 |
| 6,210,222 | B1 | 4/2001 | Langham et al. | |
| 6,257,920 | B1 * | 7/2001 | Finona et al. | 439/455 |
| 6,315,600 | B1 * | 11/2001 | Droesbeke | 439/460 |
| 6,471,545 | B1 | 10/2002 | Hosler, Sr. | |
| 7,077,699 | B2 | 7/2006 | Islam et al. | |
| 7,335,059 | B2 | 2/2008 | Vaccaro | |
| 7,347,729 | B2 | 3/2008 | Thomas et al. | |
| 7,588,460 | B2 | 9/2009 | Malloy et al. | |
| 7,635,283 | B1 | 12/2009 | Islam | |
| 7,727,013 | B1 * | 6/2010 | Paynter | 439/578 |
| 7,736,180 | B1 * | 6/2010 | Paynter | 439/578 |
| 7,806,724 | B2 * | 10/2010 | Paynter et al. | 439/578 |
| 7,824,215 | B2 * | 11/2010 | Islam et al. | 439/578 |
| 7,918,687 | B2 * | 4/2011 | Paynter et al. | 439/578 |
| 7,927,134 | B2 * | 4/2011 | Paynter et al. | 439/578 |
| 2004/0048522 | A1 * | 3/2004 | Facey et al. | 439/783 |
| 2005/0118853 | A1 | 6/2005 | Stark et al. | |
| 2010/0112856 | A1 * | 5/2010 | Paynter et al. | 439/584 |
| 2011/0021074 | A1 * | 1/2011 | Paynter et al. | 439/584 |

FOREIGN PATENT DOCUMENTS

WO 2004/055943 7/2004

OTHER PUBLICATIONS

European Search Report, related application EP 11 16 5434, issued Aug. 12, 2011 by European Patent Office, Netherlands.

* cited by examiner

*Primary Examiner* — James Harvey
(74) *Attorney, Agent, or Firm* — Babcock IP, PLLC

(57) ABSTRACT

A stabilizing coupling body assembly for a coaxial connector is provided with a coupling body dimensioned to couple at a connector end of the coupling body with a cable end of the connector. A jacket grip of rigid material is retained between the coupling body and a stabilizing body coupled to a cable end of the coupling body. An outer diameter of the jacket grip abuts an annular wedge surface of the stabilizing body. The wedge surface is provided with a taper between a maximum diameter proximate a connector end of the jacket grip and a minimum diameter proximate a cable end of the annular wedge surface. The jacket grip is driven radially inward as the stabilizing body is advanced axially towards the coupling body. Methods of manufacture include forming elements of the coupling body assembly via injection molding.

20 Claims, 3 Drawing Sheets

CONNECTOR STABILIZING COUPLING BODY ASSEMBLY

BACKGROUND

1. Field of the Invention

This invention relates to electrical cable connectors. More particularly, the invention relates to a connector stabilizing coupling body assembly for improving connector to cable retention and passive intermodulation distortion (PIM) electrical performance.

2. Description of Related Art

Coaxial cable connectors are used, for example, in communication systems requiring a high level of precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body, via a coupling body. Representative of this technology is commonly owned U.S. Pat. No. 5,795,188 issued Aug. 18, 1998 to Harwath.

Alternative forms of connector to cable end electro-mechanical interconnection include various grip surface arrangements of the connector which contact and grip the inner and/or outer conductor of the coaxial cable.

During systems installation, rotational forces may be applied to the installed connector, for example as the attached coaxial cable is routed towards the next interconnection, maneuvered into position and/or curved for alignment with cable supports and/or retaining hangers. Rotation of the coaxial cable and coaxial connector with respect to each other may damage the connector, the cable and/or the integrity of the cable/connector inter-connection. Further, once installed, twisting, bending and/or vibration applied to the interconnection over time may degrade the connector to cable interconnection and/or introduce PIM.

Prior coaxial connectors typically utilize a coupling and/or back body as a driving means for clamp and/or grip interconnection mechanisms of the connector and/or as an ease of assembly means for enabling easy insertion of internal elements within the connector, such as seals and/or electrical contact elements. Couplings and/or back bodies may also include elastomeric environmental seals compressed into a sealing configuration against the coaxial cable via a compression action with respect to the connector body. Representative of this technology is commonly owned U.S. Pat. No. 7,077,699 issued Jul. 18, 2006 to Islam et al. Although an environmental seal compressed to extend radially inward into contact with a jacket of a coaxial cable may provide a stabilizing effect upon the coaxial connector, the environmental seal is typically formed from an elastic material to enable an elastic sealing deformation contact against the jacket. Therefore, any stabilizing effect obtained from the environmental seal is limited.

Competition in the coaxial cable connector market has focused attention on improving electrical performance and minimization of overall costs, including materials costs, training requirements for installation personnel, reduction of dedicated installation tooling and the total number of required installation steps and/or operations.

Therefore, it is an object of the invention to provide a coupling and/or back body that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has recognized that movement and/or skewing of alignment between the connector and coaxial cable may generate unacceptable levels of PIM and/or otherwise compromise the electromechanical interconnection, for example as contact surfaces shift relative to one another and/or less than uniform circumferential contact occurs between the electrical contacting elements of the connector and the inner and/or outer conductors.

Figure 1:
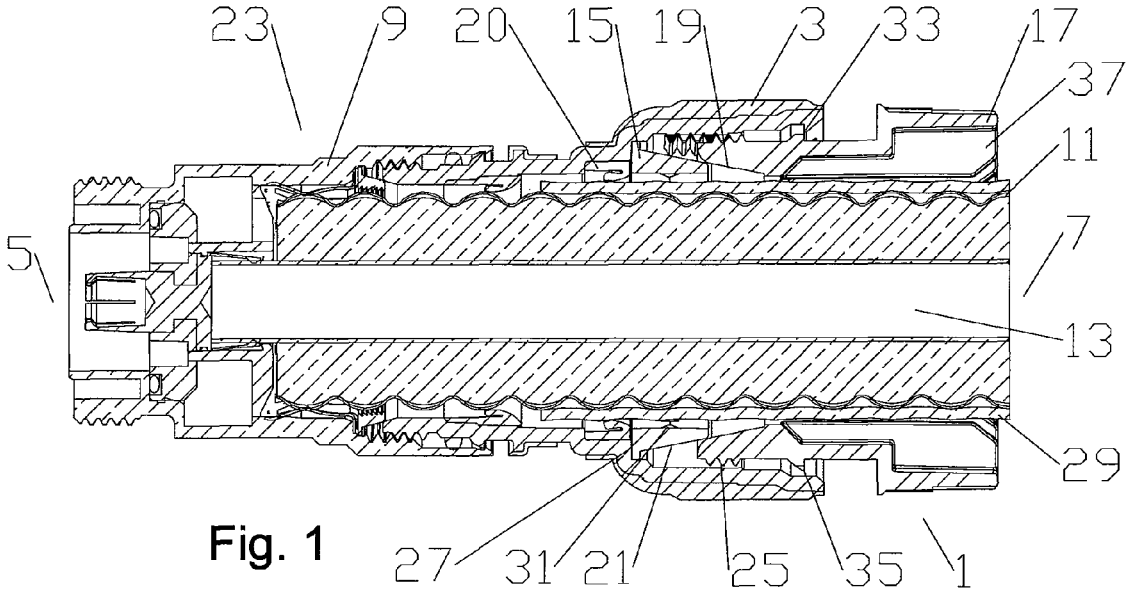
FIG. 1 is a schematic cross-section side view of a first exemplary embodiment of a coupling body assembly shown mated with an insertion coupling type coaxial connector, ready for application of the stabilizing contact upon the coaxial cable via the coupling body assembly.
Figure 2:
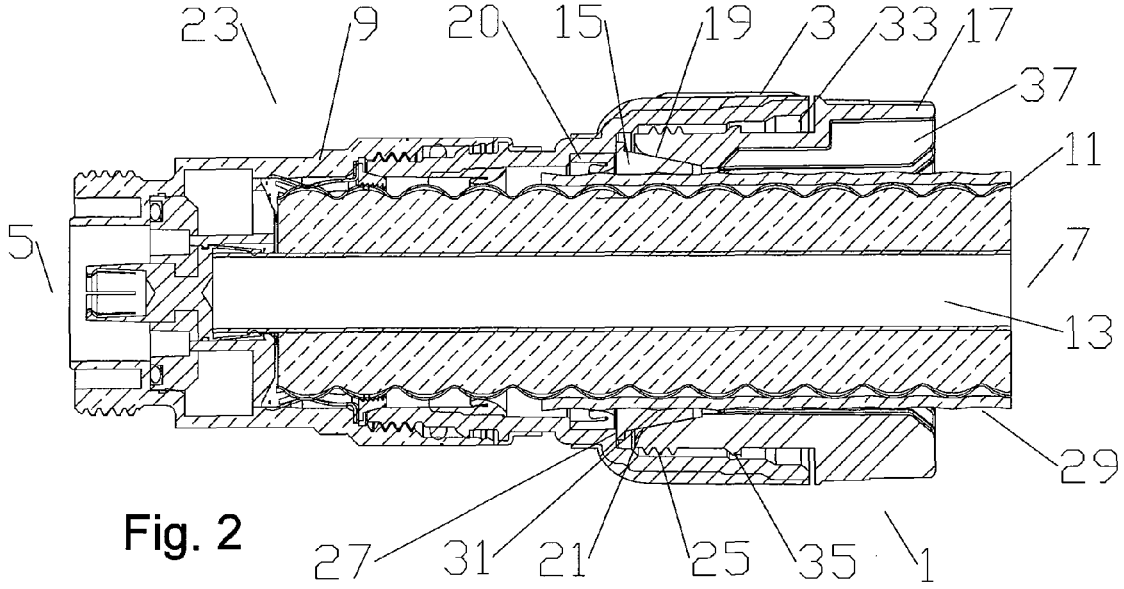
FIG. 2 is a view of FIG. 1, with the coupling body assembly applying the stabilizing contact to the coaxial cable.
Figure 3:
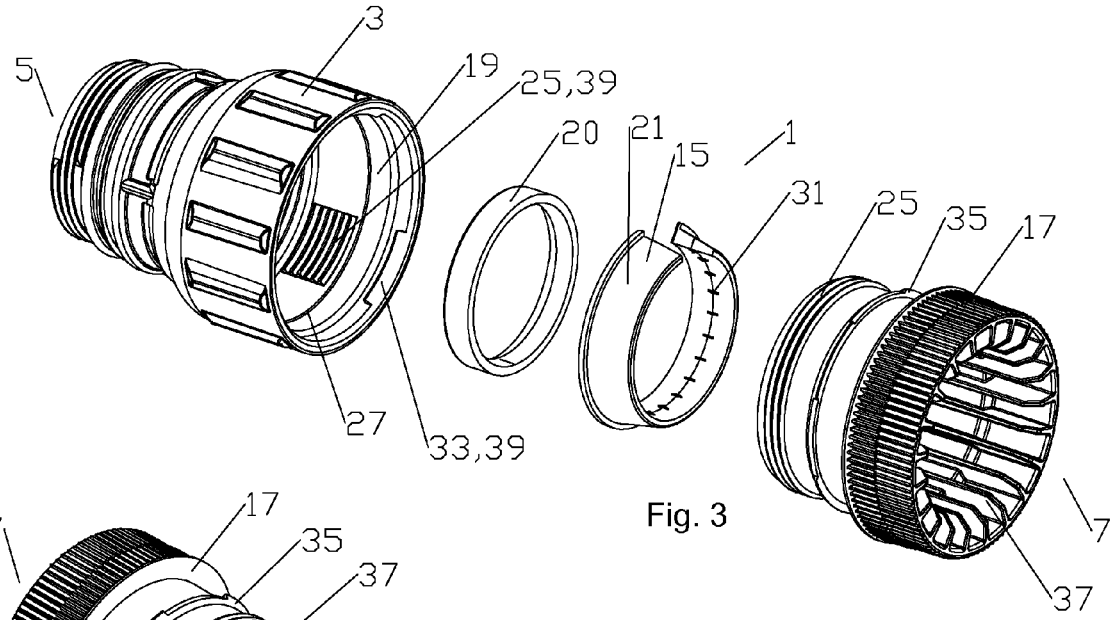
FIG. 3 is a schematic exploded angled isometric view of the coupling body assembly of FIG. 1.
Figure 4:
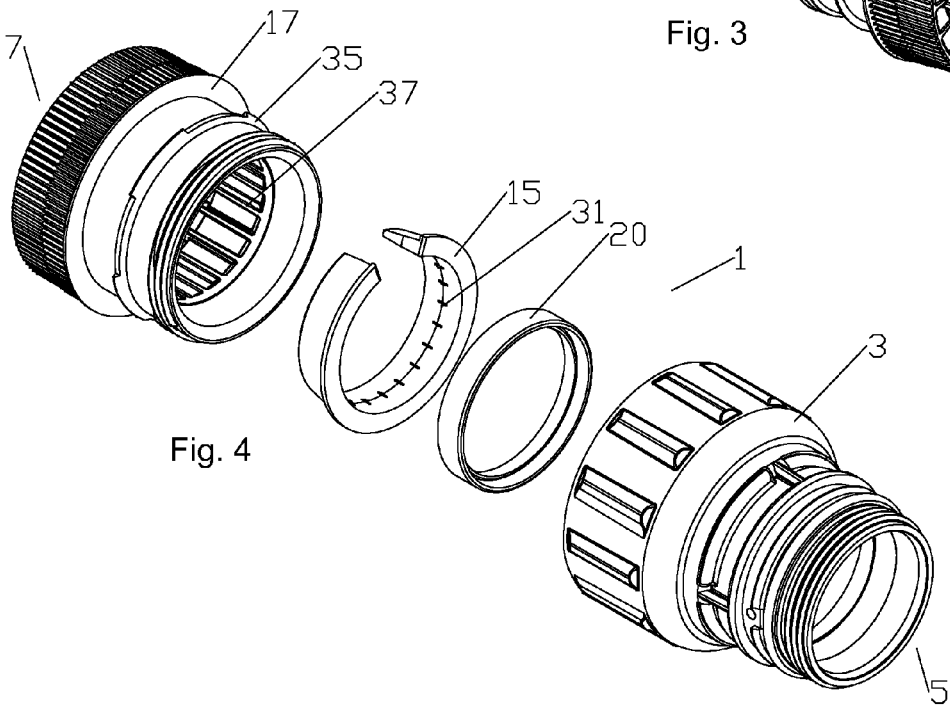
FIG. 4 is a reverse angle view of FIG. 3.

A first embodiment of a coupling body assembly 1 with a connector to cable interconnection stabilizing functionality is demonstrated in FIGS. 1-4. As best shown in FIGS. 3 and 4, the coupling body assembly 1 includes a coupling body 3 dimensioned to couple at a connector end 5 of the coupling body 3 with a cable end 7 of a coaxial connector body 9.

One skilled in the art will appreciate that connector end 5 and cable end 7 are applied herein as identifiers for respective ends of both the overall assembly and also of discrete elements of the assembly described herein, to identify same and their respective interconnecting surfaces according to their alignment along a longitudinal axis of the coaxial connector between a connector end 5 and a cable end 7.

The coupling body 3 may be configured to perform connector functions in concert with the coaxial connector body 9, such as electro-mechanical interconnection with an outer conductor 11 of a coaxial cable 13 and also environmental sealing of the electro-mechanical interconnection, for example by elastomeric sealing gasket(s) 20 seated in a gasket shoulder or annular groove of the coupling body inner diameter. Details of these functions and the associated structures of the coupling body 3 are dependent upon the type of coaxial connector 23 the coupling body assembly 1 is applied to, and as such are not further described in detail herein.

A jacket grip 15 of rigid material, for example acrylic or polycarbonate plastics, is retained between the coupling body 3 and a stabilizing body 17 coupled to a cable end 7 of the coupling body 3. The jacket grip 15 may be c-shaped, dimensioned for fit within the coupling body assembly 1 and also to enable insertion of the coaxial cable 13 therethrough during interconnection of coaxial connector 23 to coaxial cable 13.

An outer diameter of the jacket grip 15 has a contact surface 19 abutting an inner diameter annular wedge surface 21 of the stabilizing body 17, the wedge surface 21 provided with a taper between a maximum diameter proximate a connector end 5 of the jacket grip 15 and a minimum diameter proximate a cable end 7 of the wedge surface 21.

As the stabilizing body 17 is advanced axially towards the coupling body 3, for example via threads 25 or alternatively an axial compression interference fit, the angled contact surface 19 of the jacket grip 15 contacts the wedge surface 21 of the stabilizing body 17, driving the jacket grip 15 against an inward projecting shoulder 27 of the coupling body 3 and then radially inward against the jacket 29 of the coaxial cable 13. As the inner diameter of the jacket grip 15 engages the jacket 29, a secure stabilizing contact is established, distributed across a width of the jacket grip 15, between the coupling body assembly 1 and the attached coaxial connector body 9. By applying a width of the jacket grip 15, for example at least as wide as a corrugation period of a desired coaxial cable and/or at least twice as wide as a cross-sectional height of the jacket grip 15, chances of coaxial cable deformation resulting from the stabilizing contact are reduced. Because the jacket grip 15 is formed from a rigid non-compressible material and the contacts between the jacket grip 15 and the coupling body 3 and stabilizing body 17 are hard points, once the jacket 29 has deformed, if applicable, from contact therewith, the stabilizing contact is essentially rigid.

The stabilizing contact may be enhanced with respect to a longitudinal axis direction, to also improve the mechanical tear off strength of the interconnection between the coaxial connector 23 and coaxial cable 13, by applying a plurality of inward projecting protrusion(s) 31 to the inner diameter of the jacket grip 15. Further, the inward projecting protrusion(s) 31 may improve an anti rotation coaxial connector 23 to coaxial cable 13 characteristic of the stabilizing contact.

As best shown in FIG. 1, to retain the stabilizing body 17 coupled to the coupling body 3 pre-assembled but not axially tightened, a retention mechanism such as a retaining lip 33 of the coupling body 3 and a corresponding retention burr 35 of the stabilizing body 17 may be applied projecting outward and inward respectively. The retaining lip 33 and the retention burr 35 co-operate to snap engage and retain one to the other when an initial axial position has been reached. Thereby, the jacket grip 15 and any applicable environmental seals may be pre-mounted within the coupling body assembly 1 so that an installer has no initial assembly operations to perform and/or to ensure that these internal elements are not lost prior to interconnection, simplifying interconnection of the coaxial connector 23 with the coaxial cable 13.

The coupling body 3, jacket grip 15 and stabilizing body 17 may be cost effectively manufactured via injection molding, for example of polymeric material. The injection molding may be further optimized with respect to materials consumption and reduction of molding defects such as warp and sink by forming areas of the stabilizing body 17 with a plurality of inward extending support fin(s) 37, rather than a conventional solid configuration with significant material thickness areas where material strength requirements of the structure are reduced. Further, to simplify mold design and mold separation mechanics, thread(s) 25 and/or inward/outward projecting retaining lip 33 and/or retention burr 35 may be applied as arc segments 39 rather than continuous annular features. Thereby, upon rotation of the respective mold portion and/or the molded component, axial mold separation is enabled.

In use, the coaxial connector is interconnected with the coaxial cable according to the selected electro-mechanical configuration of the coaxial connector body 9 and connector end 5 of the coupling body 3, for example as shown in FIG. 1. Once the electro-mechanical interconnection is completed, the connector end 5 of the stabilizing body 17 is advanced towards the cable end 7 of the coupling body 3, in the present example by threading the threads 25 together, driving the jacket grip 15 radially inward into stabilizing contact with the jacket 29, as shown in FIG. 2.

Figure 5:
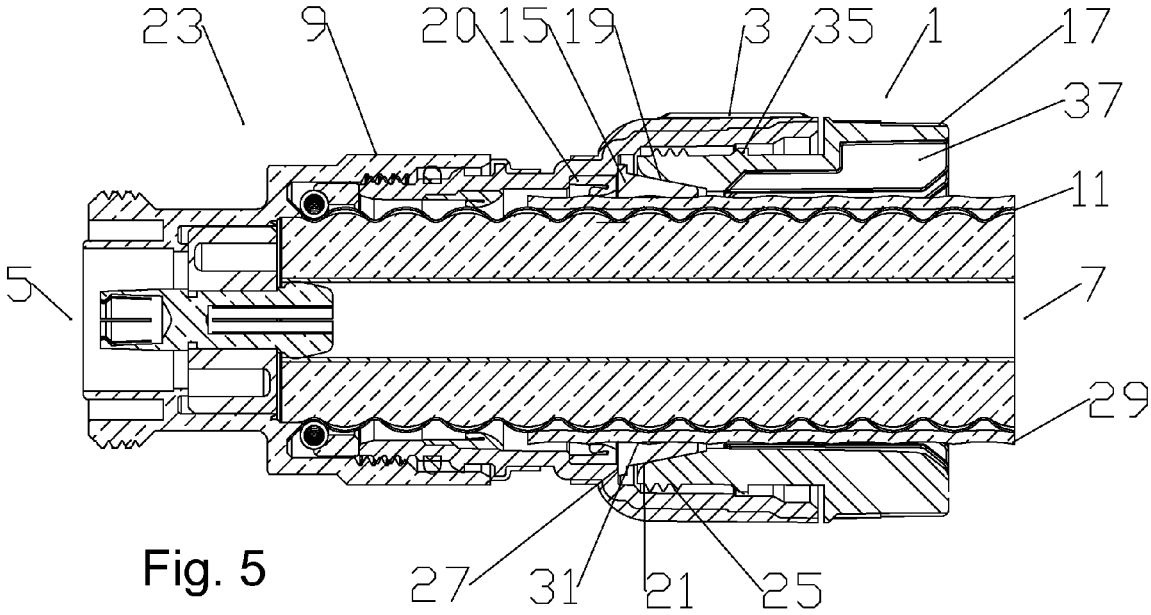
FIG. 5 is a schematic cross-section side view of the first embodiment of a coupling body assembly shown mated with an alternative coaxial connector configuration, an outer conductor leading edge clamp type coaxial connector.

One skilled in the art will appreciate the significant manufacturing, installation and interconnection stabilizing benefits of the invention. Further, because the coupling body assembly 1 is separate from the coaxial connector body 9, benefits of the invention may be applied to existing connector families by applying the coupling body assembly 1 with a standardized jacket grip 15 and stabilizing body 17, for example as shown in FIG. 5. Thereby, only minimal redesign of the coupling body 3, is required to mate the coupling body assembly 1 with any specific coaxial connector body 9 to obtain the benefits of the stabilizing contact generated thereby.

Table of Parts

| | | | |
|---|---|---|---|
| 1 | coupling body assembly | 20 | sealing gasket |
| 3 | coupling body | 21 | wedge surface |
| 5 | connector end | 23 | coaxial connector |
| 7 | cable end | 25 | threads |
| 9 | coaxial connector body | 27 | shoulder |
| 11 | outer conductor | 29 | jacket |
| 13 | coaxial cable | 31 | inward projecting protrusion |
| 15 | jacket grip | 33 | retaining lip |
| 17 | stabilizing body | 35 | retention burr |
| 19 | angled contact surface | 37 | support fin |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A stabilizing coupling body assembly for a coaxial connector, comprising:

a coupling body dimensioned to couple a connector end of the coupling body at a cable end of the connector;

a jacket grip of rigid material retained between the coupling body and a stabilizing body coupled to a cable end of the coupling body;

an outer diameter of the jacket grip abutting an annular wedge surface of the stabilizing body;

the wedge surface provided with a taper between a maximum diameter proximate a connector end of the jacket grip and a minimum diameter proximate a cable end of the annular wedge surface; whereby the jacket grip is driven radially inward as the stabilizing body is advanced axially towards the coupling body.

2. The assembly of claim 1, wherein an inner diameter of the jacket grip is provided with a plurality of inward projecting protrusions.

3. The assembly of claim 1, wherein the jacket grip is provided with an angled contact surface on the outer diameter that engages the wedge surface.

4. The assembly of claim 1, wherein the jacket grip is c-shaped.

5. The assembly of claim 1, further including a retaining lip on the coupling body and a retention burr on the stabilizing body;

the retaining lip dimensioned to engage the retention burr as the stabilizing body is coupled with the coupling body, retaining the stabilizing body upon the coupling body.

6. The assembly of claim 1, wherein a width of the jacket grip is at least as wide as a corrugation period of a coaxial cable dimensioned for coupling with the coaxial connector.

7. The assembly of claim 1, wherein a width of the jacket grip is at least as wide as twice a cross-sectional height of the jacket grip.

8. The assembly of claim 1, further including a sealing gasket seated in the coupling body adjacent to the jacket grip.

9. The assembly of claim 1, wherein the stabilizing body is coupled to the coupling body via threads.

10. A stabilizing coupling body assembly for a coaxial connector, comprising:

a coupling body dimensioned to couple at a connector end of the coupling body with a cable end of the connector;

a jacket grip of rigid material retained between the coupling body and a stabilizing body coupled to a cable end of the coupling body;

an outer diameter of the jacket grip abutting an annular wedge surface of the stabilizing body; the stabilizing body is provided with a plurality of inward projecting support fins proximate a cable end of the stabilizing body;

the wedge surface provided with a taper between a maximum diameter proximate a connector end of the jacket grip and a minimum diameter proximate a cable end of the annular wedge surface; whereby the jacket grip is driven radially inward as the stabilizing body is advanced axially towards the coupling body.

11. A method for manufacturing a stabilizing coupling body assembly for a coaxial connector, comprising the steps of:

forming a coupling body that is dimensioned to couple a connector end of the coupling body at a cable end of the connector;

forming a jacket grip of rigid material;

forming a stabilizing body dimensioned to couple to a cable end of the coupling body;

inserting the jacket grip between the coupling body and stabilizing body and coupling the coupling body to the stabilizing body;

an outer diameter of the jacket grip abutting an annular wedge surface of the stabilizing body;

the wedge surface provided with a taper between a maximum diameter proximate a connector end of the jacket grip and a minimum diameter proximate a cable end of the annular wedge surface; whereby the jacket grip is driven radially inward as the stabilizing body is advanced axially towards the coupling body.

12. The method of claim 11, wherein the jacket grip is formed by injection molding.

13. The method of claim 11, wherein the stabilizing body is formed by injection molding.

14. The method of claim 11, wherein the rigid material is acrylic.

15. The method of claim 11, further including a retaining lip on the coupling body and a retention burr on the stabilizing body;

the retaining lip engaging the retention burr as the stabilizing body is coupled with the coupling body, retaining the stabilizing upon the coupling body.

16. The method of claim 15, wherein the retaining lip and the retention burr are formed as arc segment projections.

17. The method of claim 11, wherein the coupling between the coupling body and the stabilizing body is via threads, the threads formed as arc segments.

18. A stabilizing coupling body assembly for a coaxial connector, comprising:

a coupling body dimensioned to couple a connector end of the coupling body at a cable end of the connector;

a c-shaped jacket grip of non-compressible material retained between the coupling body and a stabilizing body coupled to a cable end of the coupling body via threads; an inner diameter of the jacket grip provided with a plurality of inward projecting protrusions;

an outer diameter of the jacket grip abutting an annular wedge surface of the stabilizing body;

a retaining lip on the coupling body and a retention burr on the stabilizing body;

the retaining lip dimensioned to engage the retention burr as the stabilizing body is coupled with the coupling body, retaining the stabilizing body upon the coupling body;

the wedge surface provided with a taper between a maximum diameter proximate a connector end of the jacket grip and a minimum diameter proximate a cable end of the annular wedge surface; whereby the jacket grip is driven radially inward as the stabilizing body is advanced axially towards the coupling body.

19. The assembly of claim 1, wherein a width of the jacket grip is at least as wide as a corrugation period of a coaxial cable dimensioned for coupling with the coaxial connector.

20. The assembly of claim 1, wherein a width of the jacket grip is at least as wide as twice a cross sectional height of the jacket grip.

* * * * *